US006109246A

United States Patent [19]

Takayanagi et al.

[11] Patent Number: 6,109,246

[45] **Date of Patent: *Aug. 29, 2000**

[54] FUEL SYSTEM FOR OUTBOARD MOTOR

[75] Inventors: Masashi Takayanagi; Atsushi Noda, both of Shizuoka-Ken, Japan

[73] Assignee: Suzuki Motor Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/965,536

[22] Filed: Nov. 6, 1997

[30] Foreign Application Priority Data

Jan. 31, 1997 [JP] Japan ..... 9-019459

[51] Int. Cl.[7] ..... F02M 37/04

[52] U.S. Cl. ..... 123/516; 123/456

[58] Field of Search ..... 123/456, 516, 123/510, 509, 518, 520, 521, 73 C

[56] References Cited

U.S. PATENT DOCUMENTS

| | | | |
|---|---|---|---|
| 5,103,793 | 4/1992 | Riese | 123/516 |
| 5,231,967 | 8/1993 | Baltz | 123/516 |
| 5,309,885 | 5/1994 | Rawlings | 123/516 |
| 5,375,578 | 12/1994 | Kato | 123/516 |
| 5,389,245 | 2/1995 | Jaeger | 123/516 |
| 5,450,831 | 9/1995 | Fukuoka | 123/516 |
| 5,501,202 | 3/1996 | Watanabe | 123/509 |
| 5,598,827 | 2/1997 | Kato | 123/516 |
| 5,678,525 | 10/1997 | Taue | 123/73 C |

FOREIGN PATENT DOCUMENTS 07317617 5/1995 Japan .

*Primary Examiner*—Carl S. Miller

*Attorney, Agent, or Firm*—Finnegan, Henderson, Farabow, Garrett & Dunner, L.L.P.

[57] ABSTRACT

An outboard motor fuel supply device affording improved assembly and maintenance procedures. An outboard motor has an air intake manifold arranged on one side of the engine, and fuel flow path components that supply fuel from the fuel tank to the engine arranged together on one side of the air intake manifold.

3 Claims, 8 Drawing Sheets

FUEL SYSTEM FOR OUTBOARD MOTOR

BACKGROUND OF THE INVENTION

The present invention relates to outboard marine motors, and, more particularly, to a fuel supply device for an outboard motor.

DESCRIPTION OF RELATED ART

The fuel tank of conventional outboard motors is usually located in a side compartment within the boat. Fuel is supplied to the engine by a fuel supply device located on the side of the outboard motor. Filters, pumps, and other fuel line components used in the fuel supply device are located nearby the engine, as shown, for example, in Japanese Laid Open Patent Application Hei 7(1995)-317617. In conventional motors, the various components of the fuel supply device are connected by fuel hoses and pipes located near the motor.

Also, fuel supply parts in conventional motors are widely spaced from each other to fit in the available open spaces surrounding the motor. The fuel pipes and hoses connecting the fuel supply parts in those spaces are necessarily long, convoluted, and complex. Because of this complexity, the assembly and maintenance of the fuel supply system for the motor is complicated and expensive.

Thus, there is a need for a fuel supply system which overcomes the problems and limitations of the conventional art.

SUMMARY OF THE INVENTION

The present invention is addressed to a solution of the problems and limitations of conventional motor fuel systems, and to providing an outboard motor fuel supply device that can be assembled and maintained in an improved manner.

To achieve these and other advantages and in accordance with the purpose of the invention, as embodied and broadly described, the invention is a fuel supply device for an outboard motor having an air intake manifold located on one side of an engine, and attached to the engine. Fuel line components that couple a fuel connector to at least one fuel injector are arranged together on one side of the air intake manifold. More particularly, some of the fuel line components of the present invention are attached to the air intake manifold.

In another aspect of the invention, a vapor separator is inserted in the fuel supply path, and is located on the inner side of the air intake pipes of the air intake manifold, between the manifold and the engine block.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute a part of the specification, illustrate several embodiments of the invention, and together with the description serve to explain the principles of the invention. In the drawings.

DESCRIPTION OF THE PREFERRED EMBODIMENT

Reference will now be made in detail to the present preferred embodiments of the invention, examples of which are described in the accompanying specification and illustrated in the accompanying drawings.

While the present invention can be broadly applied in the field of outboard motors, it is especially well suited for use in a water cooled outboard motor having a fuel tank located within the boat, or a remote fuel tank separate from the motor.

Figure 1:
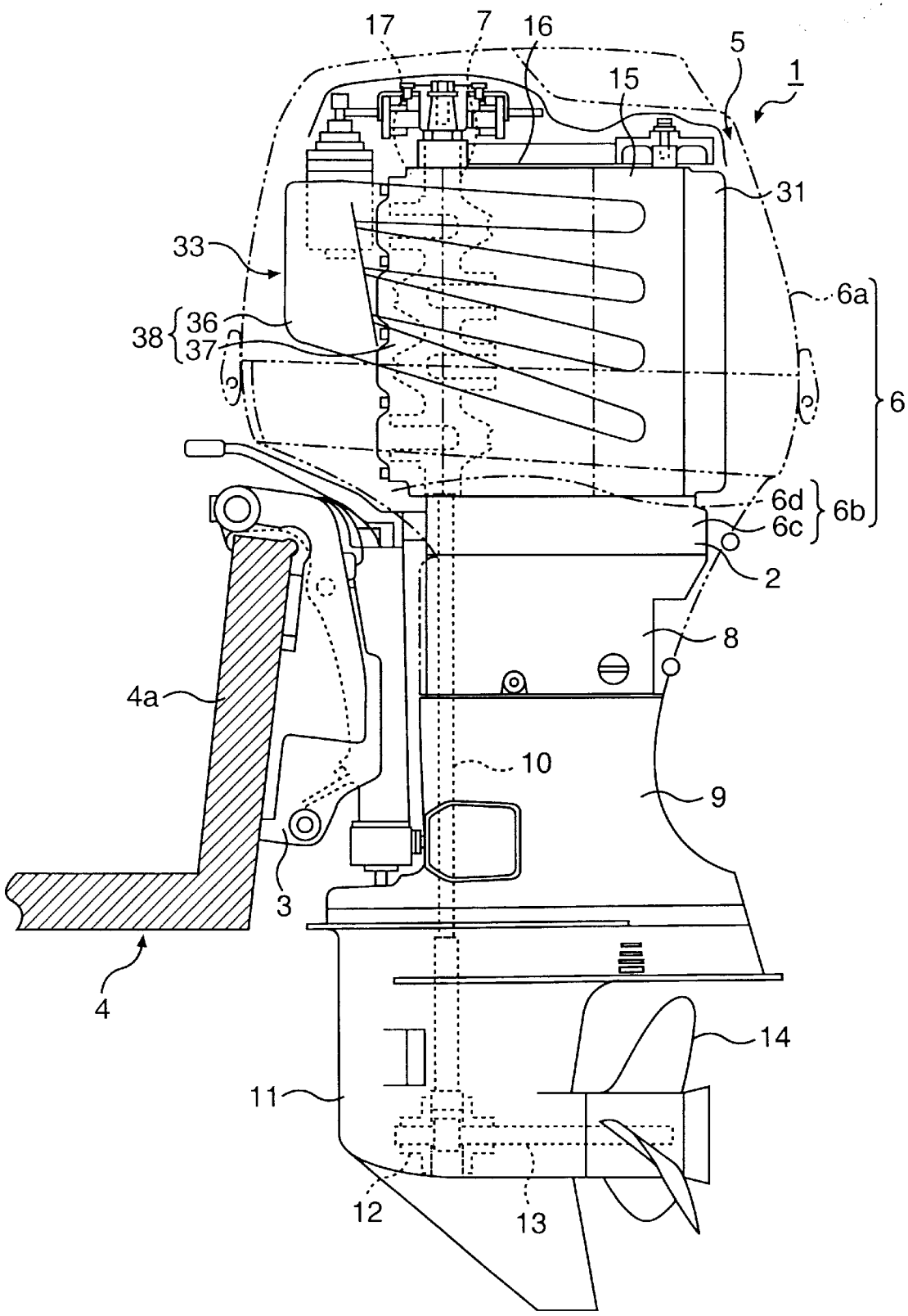
FIG. 1 is a side view showing an embodiment of the outboard motor fuel supply device of the present invention.
Figure 2:
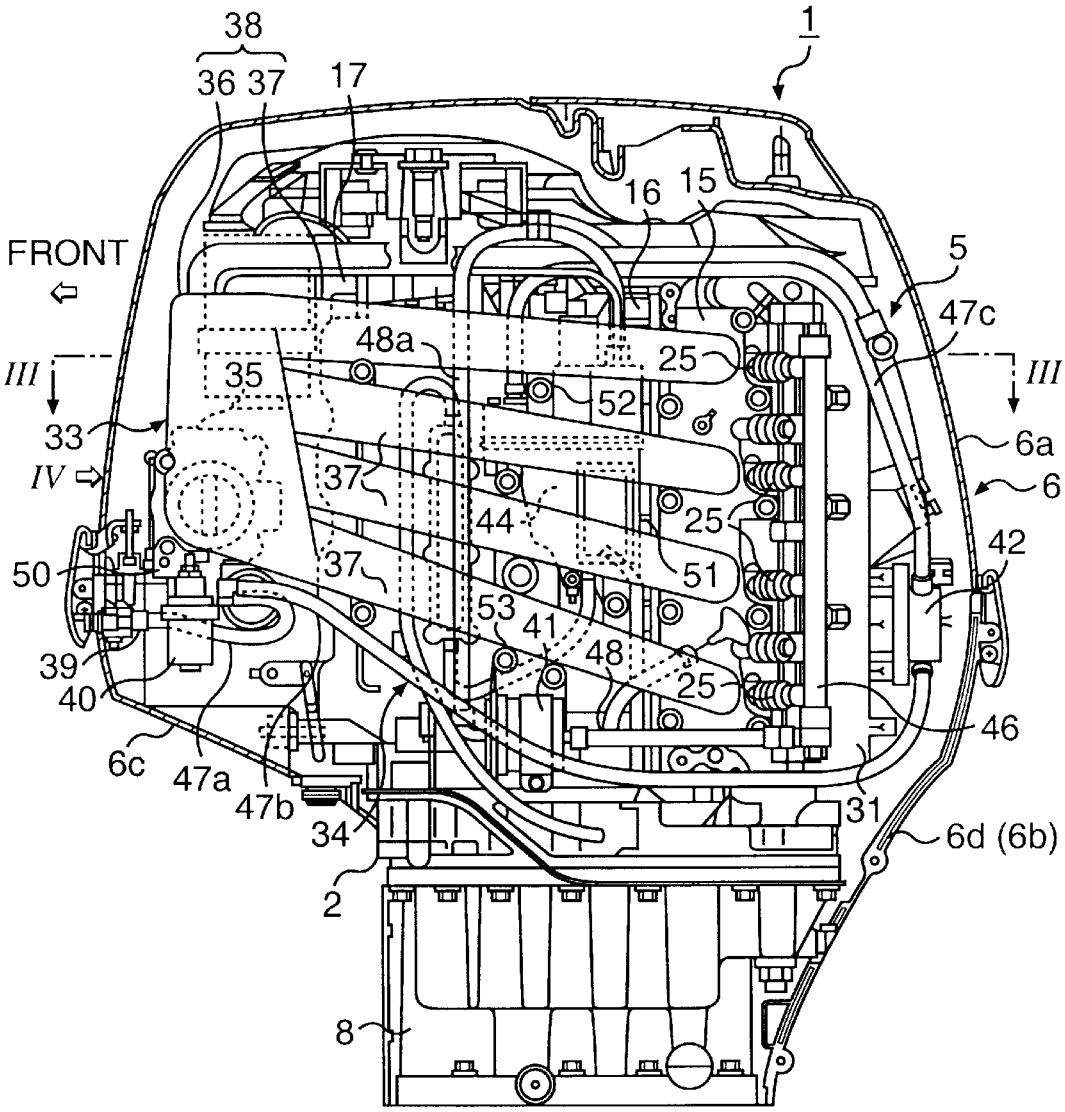
FIG. 2 is a side view showing an enlargement of the engine of FIG. 1.
Figure 3:
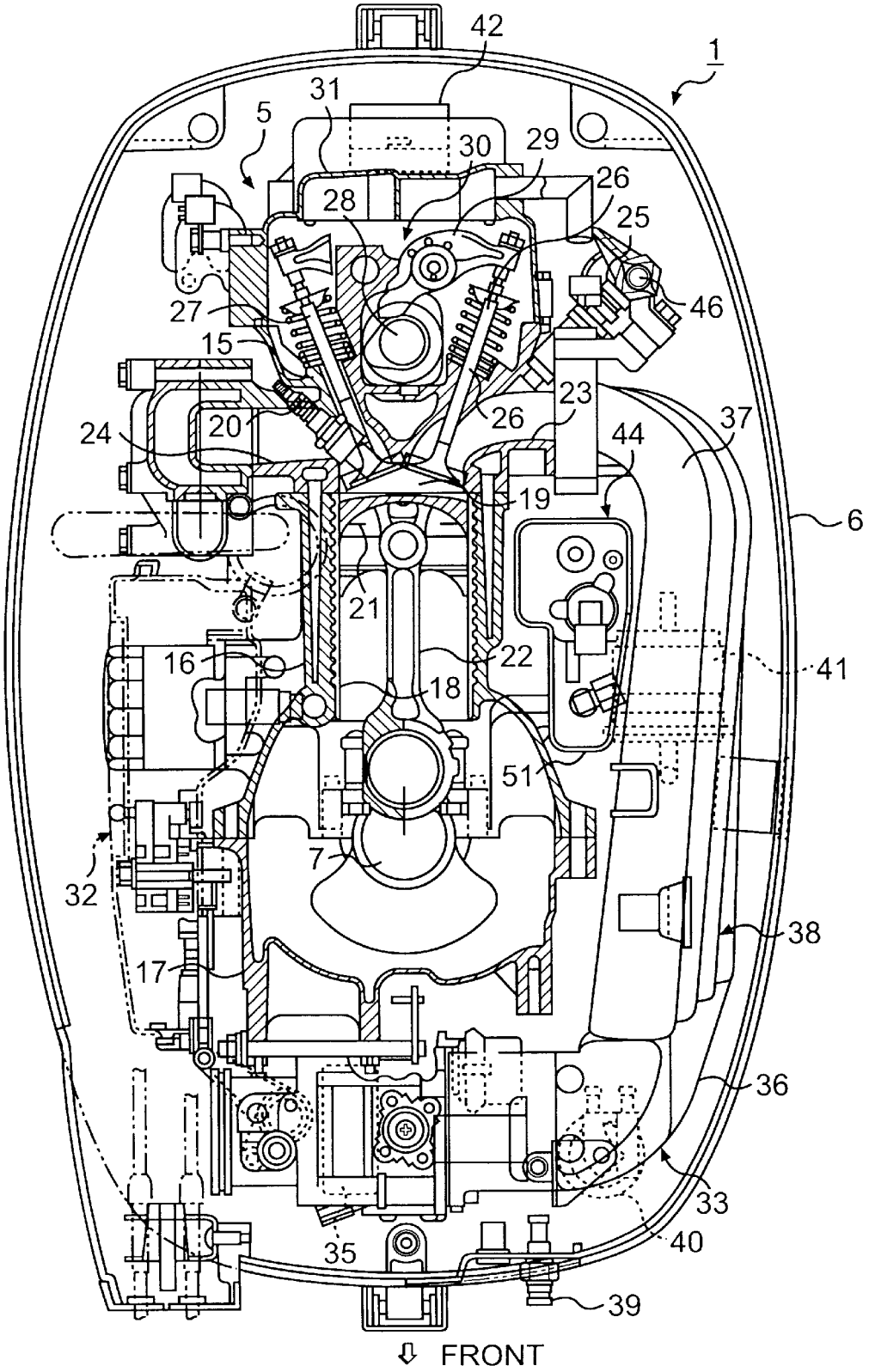
FIG. 3 is a cross section on line III—III of FIG. 2.
Figure 4:
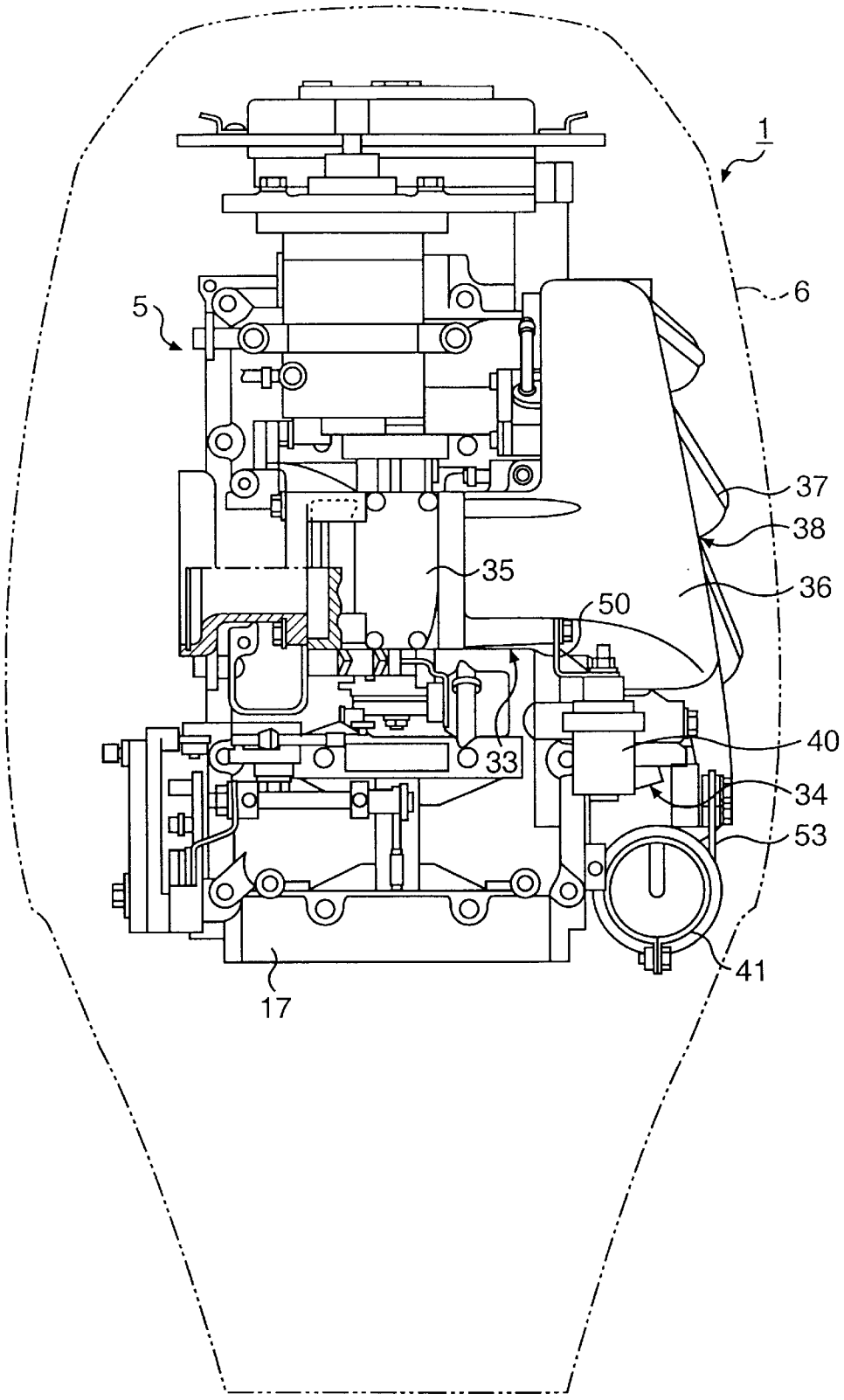
FIG. 4 is a perspective view in the direction of arrow IV of FIG. 2.
Figure 5:
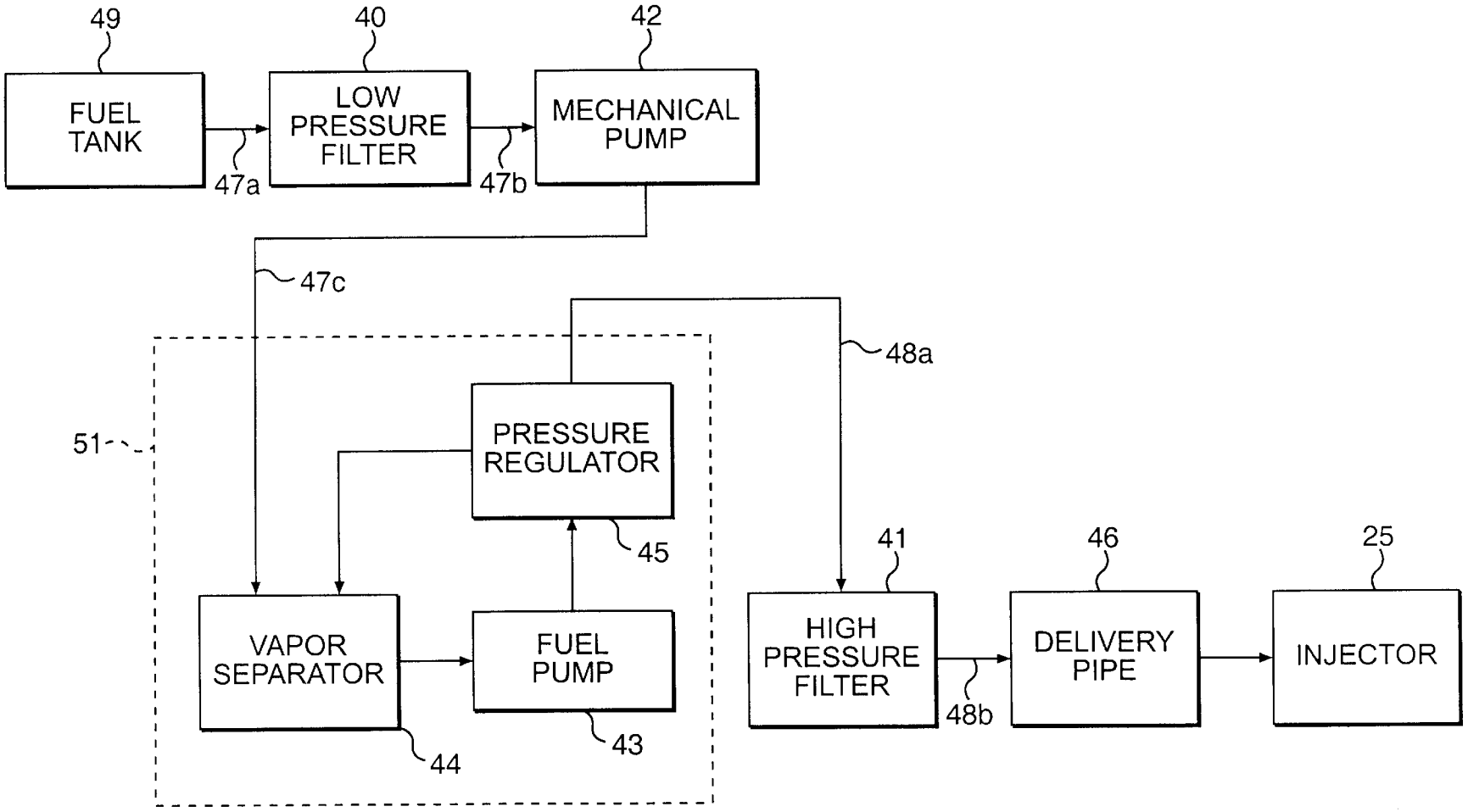
FIG. 5 is a block diagram showing the fuel supply device.
Figure 6:
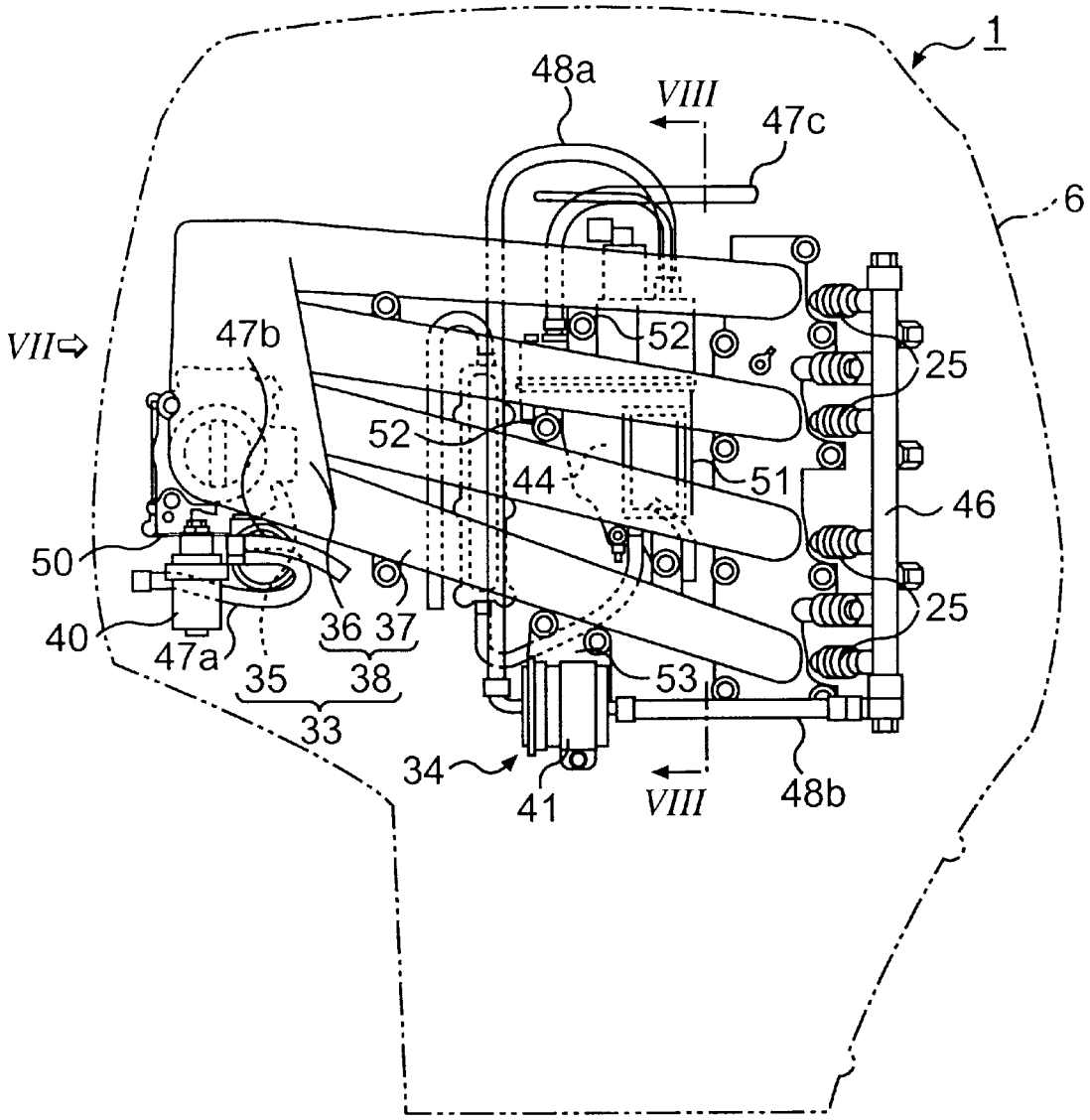
FIG. 6 a side view showing the embodiment of FIG. 2, with the air intake device and the fuel supply device removed.
Figure 7:
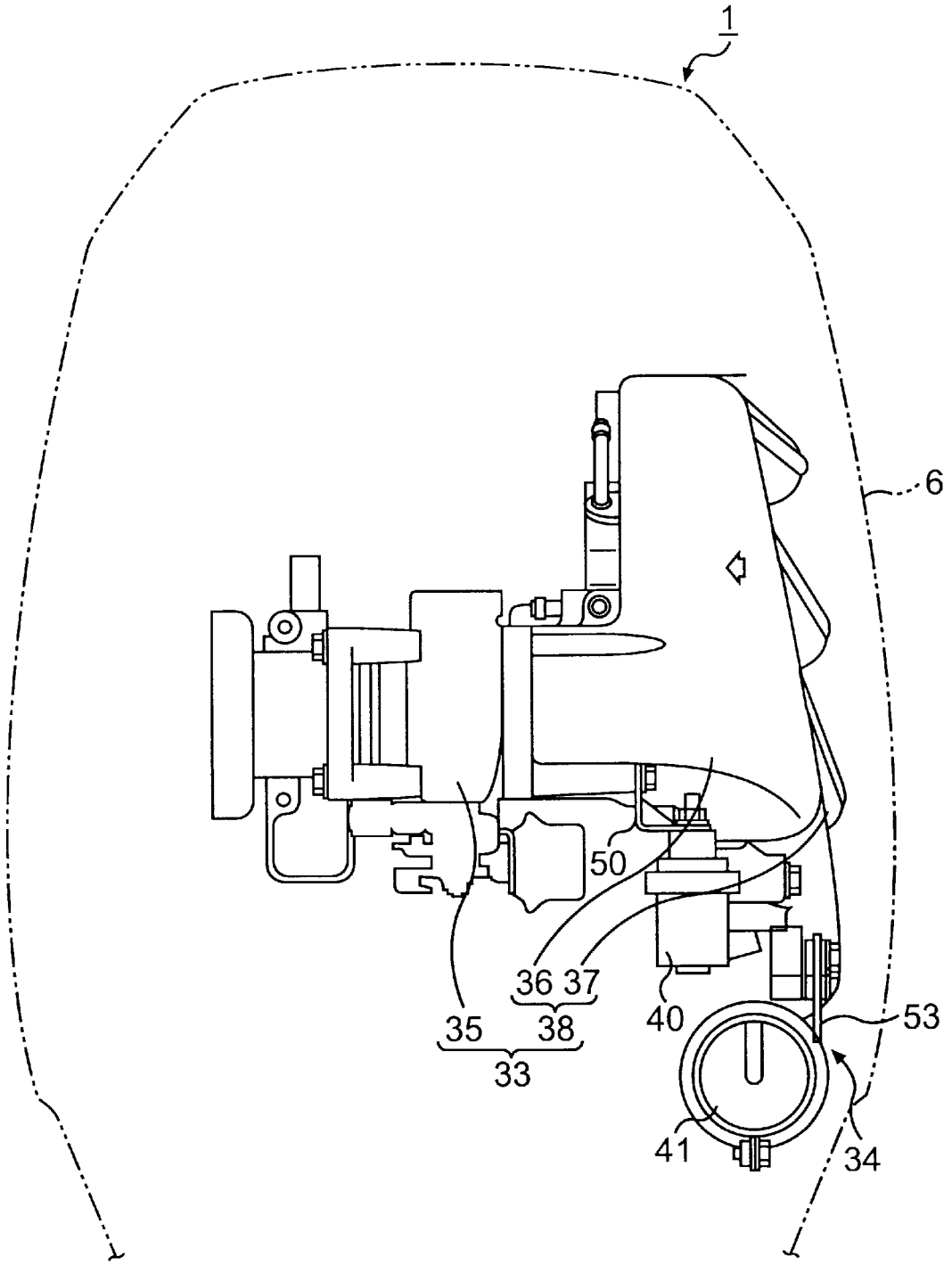
FIG. 7 is a perspective view in the direction of arrow VII of FIG. 6.
Figure 8:
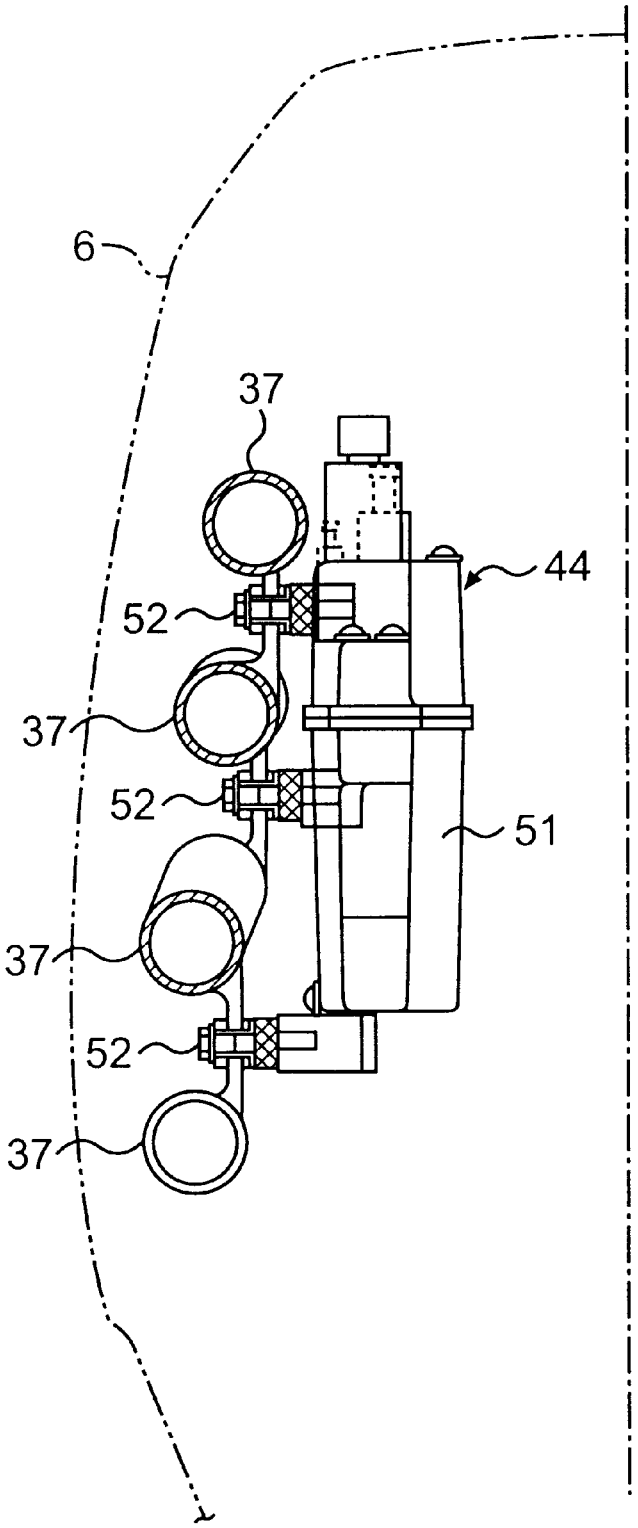
FIG. 8 is cross section on line VIII—VIII of FIG. 6.

FIG. 1 shows an outboard motor incorporating one embodiment of the present invention. Outboard motor (1) includes a plate-like engine holder (2), and is mounted to a transom **(4*a*) of boat (4) by means of a bracket (3) attached to the engine holder (2)**.

An engine (5) is located above the engine holder (2). The engine and the surrounding components are covered with an engine cover (6). The engine cover (6) can be separated into top and bottom parts to provide an upper cover **(6*a*) and a lower cover (6*b*). In addition, the lower cover (6*b*) can be separated into right and left portions. Lower cover (6*b*) protects the lower part of the engine (5) and the area surrounding engine holder (2), while the upper part of the engine (5) is covered by upper cover (6*a*)**.

A crank shaft (7) is oriented vertically within the engine (5), so that it is generally at a right angle to the hull of the boat. Drive shaft housing (9) shields the oil pan (8), and is located below engine holder (2). A drive shaft (10) extends downward through the oil pan (8) and the drive shaft housing (9). The drive shaft is connected to the bottom end of the crank shaft (7). A propeller (14) is driven by a propeller shaft (13) located in the bottom part of the drive shaft housing (9), and connected to drive shaft (10) by bevel gear (12).

As shown in FIGS. 1–4, engine (5) can be a water-cooled, four-cycle, four-cylinder engine, for example having a cylinder head (15), a cylinder block (16), and a crank case (17).

A cylinder (18) is formed in the engine cylinder block (16). A combustion chamber (19) complementing cylinder (18) is formed in the cylinder head (15). A spark plug (20) penetrates the combustion chamber (19), and extends outward from the cylinder head. A piston (21) is inserted vertically into the cylinder, and is able to reciprocate freely. The piston (21) and the crank shaft (7) are joined by a connecting rod so that the power stroke of the piston (21) is converted into rotational motion of the crank shaft (7).

An exhaust port (24) and an air intake port (23) are formed in the cylinder head (15), and are connected to the combustion chamber (19). An injector (25), that injects fuel into the air intake port (23), is attached to the cylinder head (15). An air intake valve (26) and an exhaust valve (27), that open and close respectively ports (23) and (24), are located in the cylinder head. A camshaft (28), a rocker arm (29), and other valve operating linkages are placed on the cylinder head. The cylinder head (15) is covered by a cylinder head cover (31).

Electrical instrumentation (32), an air intake device (33), and a fuel supply device (34) are located adjacent to the engine. The principal components of air intake device (33) are the throttle body (35), the air intake manifold (38), a surge tank (36), and multiple air intake pipes (37) extending from the surge tank (36) to each cylinder. The components of the air intake device are arranged together on one side of the engine (5), while the electrical instrumentation is collected and arranged on the side of the engine opposite from the air intake device (33).

The throttle body (35) of the intake device can be located, for example, on the front part of the engine crank case (17). The surge tank is located on the side of the throttle body (35). The air intake pipes (37) are stacked vertically on a side of the cylinder body (16), and connect the cylinder air intake ports (23) formed in the cylinder head (15) to the surge tank (36).

As shown in FIGS. 5–8, the fuel supply device (34) of the present invention includes filters, pumps, and other components of the fuel line. In particular, the device comprises a fuel connector (39), multiple fuel filters (40, 41), multiple fuel pumps (42, 43), a vapor separator (44), a pressure regulator (45), a delivery pipe (46), and an injector (25). The fuel system components are connected by fuel hoses (47, 48).

The outboard motor (1) of the present embodiment has a fuel tank (49) located in a side compartment of the boat (4). A fuel supply hose (not shown in the figure) that extends from the fuel tank (49) is connected to a fuel connector (39) located on the front panel of the lower cover (6*b*). A low pressure filter (40) is attached to the underside of the surge tank (36) by way of a bracket (50). The low pressure filter (40) and the fuel connector (39) are connected by a low pressure fuel hose (47*a*).

A low pressure mechanical pump (42) driven by cam shaft (28) is located within the cylinder head cover (31). The mechanical pump (42) and the low pressure filter (40) are connected by a low pressure fuel hose (47*b*).

As shown in FIGS. 2 and 6–8, a space is formed between the cylinder block (16) and the stack of air intake pipes (37) of the air intake manifold (38). Within this space there is a separator case (51) which contains a vapor separator (44). Separator case (51) is attached to the inner side of the stack of air intake pipes (37) by bolts, or by other fasteners. The vapor separator (44) separates the vapor from liquid fuels and releases the vapor, but not the liquid, into the atmosphere. In this application, for example, vapor is separated from the liquid gasoline. The fuel is supplied from the mechanical pump (42) to the vapor separator (44) via the low pressure fuel hose (47*c*).

A high pressure fuel pump (43) and a pressure regulator (45) are contained within the separator case (51). After vapor has been separated from the fuel, the fuel is supplied to a pressure regulator (45) and to a high pressure filter (41), fixed by a bracket to the lower parts of the air intake pipes. These components are connected by a high pressure fuel hose (48*a*).

High pressure fuel transferred to high pressure filter (41) is then supplied via the high pressure fuel hose to a delivery pipe (46) attached to the air intake pipes (37). Injectors (25) are connected to delivery pipe (46) and are attached to their respective cylinders, so that each injector (25) injects high pressure fuel into the air intake port (23) of the corresponding cylinder.

All of the fuel line components of the fuel supply device, located between the fuel connector (39) and the injector (25), are arranged together on one side of the engine intake manifold (38). As a result, the piping connecting the various fuel line components is reduced to a minimum and simplified. This design results in a reduction in cost of the motor, and allows for better assembly and maintenance procedures to be developed.

Because some of the fuel system components are attached to the air intake manifold (38), the air intake device (33) and the fuel supply device (34) can be treated as a unit, the fuel hoses (47, 48) can be made shorter, and the fuel supply piping can be simplified. These features further improve the assembly and maintenance procedures used for the motor. Additionally, by locating the vapor separator (44) between the air intake pipes (37) and the engine block (16), a more compact engine can be made.

The outboard motor fuel supply device of the present invention includes an outboard motor having an air intake manifold located on one side of the engine, and all the fuel line components that supply fuel from the fuel tank to the engine collected and arranged on one side of the air intake manifold. This layout permits the development of better maintenance procedures for the fuel line components of the motor. The assembly of the fuel related components is also improved, because many of the components are attached to the air intake manifold and can be handled as a unit with the intake manifold. A more compact engine can be made using this design, because the vapor separator that is a part of the fuel line is located in the space between the air intake pipe and the engine block.

It will be apparent to those skilled in the art that various modifications and variations can be made in the structure of the present invention without departing from the spirit or scope of the invention. Thus, it is intended that the present invention cover the modifications and variations of this invention provided they come within the scope of the appended claims and their equivalents.

What is claimed is:

1. An outboard motor fuel supply device for an engine disposed in a cowling having first and second surfaces, and including an engine block centerline extending between the first and second flank surfaces, the device comprising:

an air intake manifold located adjacent to the first flank surface of the engine cowling;

at least one injector disposed on the engine;

a fuel connector for receiving fuel from a fuel supply; and fuel line components coupling the fuel connector to the at least one injector, the fuel line components including a fuel filter, a fuel pump, a vapor separator and a pressure regulator;

wherein the at least one injector, the fuel connector, and the fuel line components are arranged together between the engine block centerline and the air intake manifold.

2. The outboard motor fuel supply device of claim 1, wherein at least one of the at least one injector, the fuel connector, and the fuel line components is attached to the air intake manifold.

3. An outboard motor fuel supply device for an engine disposed in a cowling having first and second side surfaces, and including an engine block centerline extending between the first and second side surfaces, the device comprising:

an air intake manifold located adjacent to the first side surface of the engine cowling and including an air intake pipe;

at least one injector disposed on the engine;

a fuel connector for receiving fuel from a fuel supply; and fuel line components coupling the fuel connector to the at least one injector;

wherein the at least one injector, the fuel connector, and the fuel line components are arranged together between the engine block centerline and the air intake manifold, and the fuel line components further comprise a vapor separator disposed between a side of the air intake pipe and the engine block centerline.

* * * * *